US006965277B2

(12) United States Patent
Kawanami

(10) Patent No.: US 6,965,277 B2
(45) Date of Patent: Nov. 15, 2005

(54) TWO-PORT NON-RECIPROCAL CIRCUIT DEVICE, COMPOSITE ELECTRONIC COMPONENT, AND COMMUNICATION APPARATUS

(75) Inventor: Takashi Kawanami, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 152 days.

(21) Appl. No.: 10/746,662

(22) Filed: Dec. 26, 2003

(65) Prior Publication Data

US 2005/0190007 A1 Sep. 1, 2005

(30) Foreign Application Priority Data

Mar. 18, 2003 (JP) ..... 2003-074270

(51) Int. Cl.[7] ..... H01P 1/36

(52) U.S. Cl. ..... 333/24.2; 333/1.1

(58) Field of Search ..... 333/24.2, 1.1

(56) References Cited

U.S. PATENT DOCUMENTS 4,016,510 A 4/1977 Hodges, III et al. ..... 333/24.2
5,821,830 A * 10/1998 Hasegawa ..... 333/1.1

FOREIGN PATENT DOCUMENTS

JP 2002-299916 10/2002

* cited by examiner

*Primary Examiner*—Stephen E. Jones
(74) *Attorney, Agent, or Firm*—Keating & Bennett, LLP

(57) ABSTRACT

In a two-port non-reciprocal circuit device, connecting portions of a first central electrode are electrically connected to first and second balanced input terminals, respectively. Likewise, connecting portions of a second central electrode are electrically connected to first and second balanced output terminals, respectively. First and second resistors are electrically connected between the first balanced input terminal and the first balanced output terminal and between the second balanced input terminal and the second balanced output terminal, respectively. First to fourth matching capacitors are electrically connected between the connecting portions of the first and second central electrodes and ground, respectively.

20 Claims, 11 Drawing Sheets

TWO-PORT NON-RECIPROCAL CIRCUIT DEVICE, COMPOSITE ELECTRONIC COMPONENT, AND COMMUNICATION APPARATUS

BACKGROUND OF THE INVENTION

1. Field of the Invention

The present invention relates to a two-port non-reciprocal circuit device, such as an isolator used in a microwave band, a composite electronic component, and a communication apparatus.

2. Description of the Related Art

Two-port non-reciprocal circuit devices disclosed in U.S. Pat. No. 4,016,510 (Patent Document 1) and Japanese Unexamined Patent Application Publication No. 2002-299916 (Patent Document 2) are known. In the two-port non-reciprocal circuit device according to Patent Document 1, a first central electrode and a second central electrode are arranged on the upper surface of a ferrite member such that the electrodes cross each other and are electrically insulated from each other. One end of each of the first and second central electrodes is grounded, and the other ends thereof are electrically connected to an input terminal and an output terminal, respectively. Also, a resistor is electrically connected between the other end of the first central electrode and the other end of the second central electrode. Further, matching capacitors are electrically connected between the other ends of the first and second central electrodes and ground. Each of the input and output terminals is an unbalanced terminal.

In the two-port non-reciprocal circuit device shown in FIG. 11 of Patent Document 2, one end of a first central electrode in the input side is grounded and the other end thereof is electrically connected to an unbalanced input terminal. A matching capacitor is electrically connected between the other end of the first central electrode and ground. Both ends of a second central electrode in the output side are electrically connected to a balanced output terminal through matching capacitors. Also, a resistor is electrically connected between the other end of the first central electrode and the other end of the second central electrode. Further, a matching capacitor is electrically connected between both ends of the second central electrode.

In the two-port non-reciprocal circuit device of the Patent Document 1, however, both input and output terminals are unbalanced terminals, and thus cannot be connected to a balanced circuit. In order to connect the two-port non-reciprocal circuit device to the balanced circuit, a balanced-to-unbalanced transformer (balun) has to be provided to the input/output sides of the non-reciprocal circuit device. In this way, when the balun and the non-reciprocal circuit device are used together, the size and cost of the device increase, the structure is complicated, and reliability decreases.

Also, in the two-port non-reciprocal circuit device of Patent Document 2, only one of the two balanced output terminals is electrically connected to an unbalanced input terminal via a resistor. Therefore, it causes imbalance between the two balanced output terminals. Accordingly, the common mode rejection ratio of the non-reciprocal circuit device decreases, and thus the amount of signals which are input to the two balanced terminals in a common mode and which are output increases. As a result, undesired waves other than necessary signal waves pass through the non-reciprocal circuit device disadvantageously.

SUMMARY OF THE INVENTION

In order to overcome the problems described above, preferred embodiments of the present invention provide a two-port non-reciprocal circuit device which can be connected to a balanced circuit without using a balun and which has a large common mode rejection ratio, and also provide a composite electronic component and a communication apparatus including the novel two-port non-reciprocal circuit device.

A two-port non-reciprocal circuit device according to a preferred embodiment of the present invention includes:

(a) a permanent magnet;

(b) a ferrite member to which a DC magnetic field is applied by the permanent magnet;

(c) a first central electrode provided on the ferrite member;

(d) a second central electrode provided on the ferrite member, the first and second central electrodes crossing each other and being electrically insulated from each other;

(e) a first resistor which is electrically connected between one end of the first central electrode and one end of the second central electrode;

(f) a second resistor which is electrically connected between the other end of the first central electrode and the other end of the second central electrode;

(g) a first terminal which is electrically connected to the one end of the first central electrode and a second terminal which is electrically connected to the other end of the first central electrode; and (h) a third terminal which is electrically connected to the one end of the second central electrode and a fourth terminal which is electrically connected to the other end of the second central electrode; wherein the first and second terminals are balanced input terminals and the third and fourth terminals are balanced output terminals.

Preferably, the resistances of the first and second resistors are almost equal to each other. Further, the ferrite member preferably has a substantially parallelogram-shaped configuration when viewed in a plan view.

The two-port non-reciprocal circuit device having the above-described configuration can be connected to a balanced circuit without using a balun.

In order to match the impedance of the two-port non-reciprocal circuit device to that of the balanced circuit connected to the two-port non-reciprocal circuit device, matching capacitors are electrically connected between both ends of the central electrodes, matching capacitors are electrically connected between each end of the central electrodes and ground, or matching capacitors are electrically connected between each end of the central electrodes and the first to fourth terminals.

Also, a composite electronic component according to a preferred embodiment of the present invention includes the two-port non-reciprocal circuit device having the above-described characteristics and a power amplifier which is electrically connected to the two-port non-reciprocal circuit device, wherein a balanced output terminal of the power amplifier is electrically connected to the balanced input terminal of the two-port non-reciprocal circuit device. In this composite electronic component, a load impedance from the side of the output terminal of the power amplifier is constant regardless of the operating state of a subsequent-stage circuit or the operating environment. Therefore, the power load efficiency and output distortion characteristic of the power amplifier can be constantly maintained at the optimal state.

Further, a communication apparatus according to another preferred embodiment of the present invention includes the two-port non-reciprocal circuit device and the composite electronic component having the above-described characteristics. Accordingly, a compact communication apparatus having an excellent stable load regulation can be obtained.

Other features, elements, characteristics and advantages of the present invention will become more apparent from the following detailed description of preferred embodiments of the present invention.

DETAILED DESCRIPTION OF PREFERRED EMBODIMENTS

Hereinafter, a two-port non-reciprocal circuit device, a composite electronic component, and a communication apparatus according to various preferred embodiments of the present invention will be described with reference to the attached drawings.

First Preferred Embodiment

Figure 1:
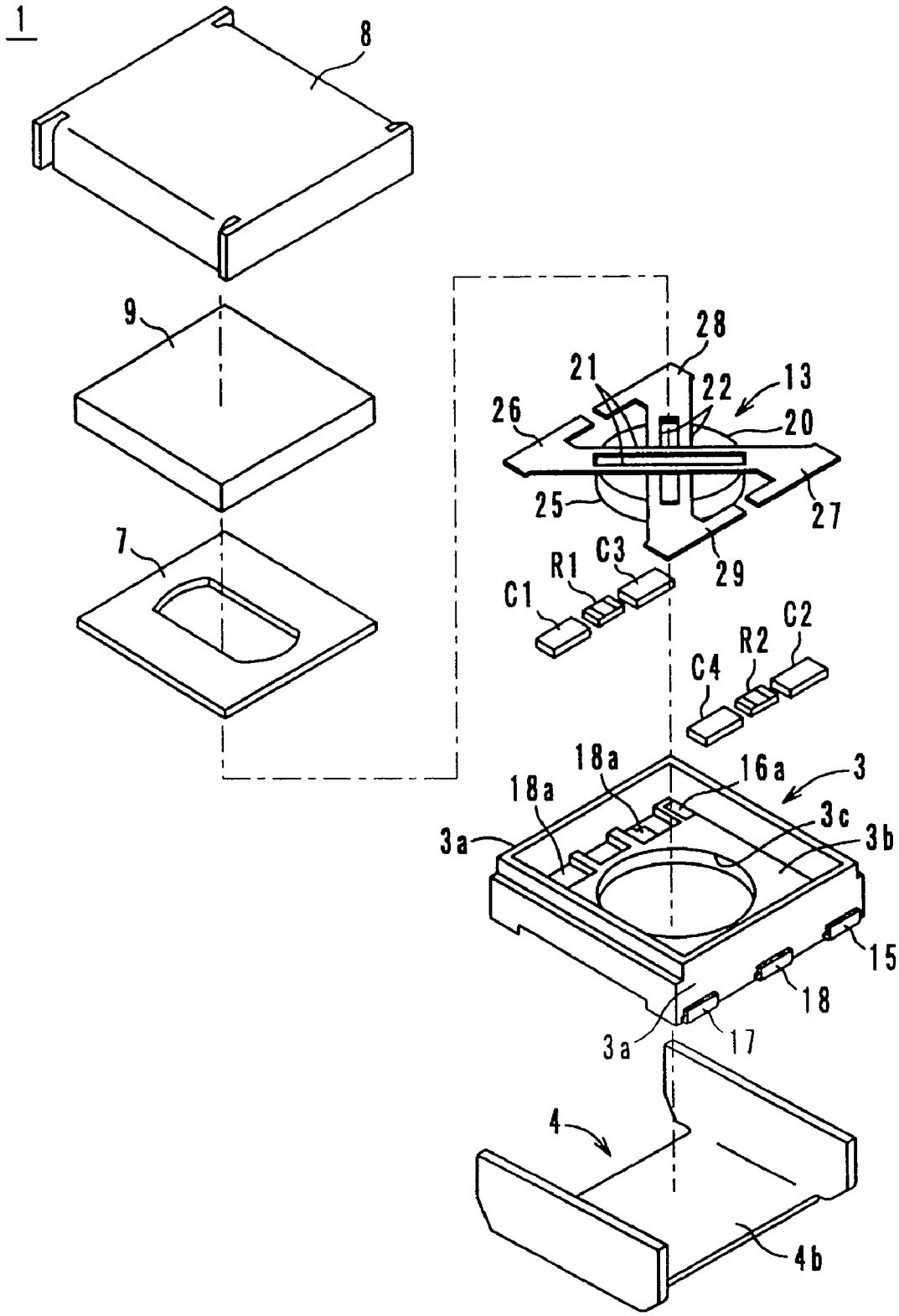
FIG. 1 is an exploded perspective view showing a two-port non-reciprocal circuit device according to a first preferred embodiment of the present invention.

As shown in FIG. 1, a two-port isolator 1 according to a first preferred embodiment of the present invention preferably includes a metallic lower case 4, a resin terminal case 3, a central electrode assembly 13, a metallic upper case 8, a permanent magnet 9, an insulating member 7, resistors R1 and R2, and matching capacitors C1 to C4.

The metallic lower case 4 and the metallic upper case 8 are preferably made of a ferromagnetic material, such as soft iron, so as to form a magnetic circuit. The surface thereof is preferably Ag-plated or Cu-plated so as to improve an insertion loss characteristic. The insulating member 7 preferably includes a dielectric material, such as LCP (liquid crystal polymer), PPS, PBT, PEEK, or epoxy resin, or other suitable material.

In the central electrode assembly 13, a first central electrode 21 and a second central electrode 22 are arranged on the upper surface of a disc-shaped microwave ferrite member 20, such that the electrodes cross each other at substantially right angles and are electrically insulated from each other. The ferrite member 20 normally includes a YIG ferrite. The first central electrode 21 has connecting portions 26 and 27 at both ends thereof, and the second central electrode 22 has connecting portions 28 and 29 at both ends thereof. A ground electrode 25 is provided on the lower surface of the ferrite member 20. The ground electrode 25 of the central electrode assembly 13, which is provided on the lower surface of the ferrite member 20, is connected to a bottom wall 4*b* of the metallic lower case 4 through a window 3*c* of the resin terminal case 3 by soldering or other suitable connection, so as to be grounded.

Preferably, each of the central electrodes 21 and 22 has some values of inductance corresponding to each operating frequency, because the inductance of the central electrodes 21 and 22 is one of the important factors which determine the operating bandwidth and the input impedance in the center frequency of the isolator 1. On the other hand, the width of each of the central electrodes 21 and 22 is preferably about 20% to about 45% of the diameter of the ferrite member 20. If the width of each of the central electrodes 21 and 22 is less than about 20% of the diameter of the ferrite member 20, a component which is vertical to the principal surface of the ferrite member 20 in a high-frequency magnetic flux of the ferrite member 20, in other words, a component which is parallel with a DC biased magnetic field, is increased. A high-frequency magnetic field component in the ferrite member 20, which is parallel with the DC biased magnetic field, does not contribute to non-reciprocal magnetic coupling between the central electrodes 21 and 22. Therefore, a coupling coefficient between the central electrodes 21 and 22 decreases, insertion loss and reflection loss of the isolator 1 increase, and thus the operating frequency bandwidth is deteriorated.

On the other hand, if the width of each of the central electrodes 21 and 22 is greater than approximately 45% of the diameter of the ferrite member 20, the adjacent connecting portions 26 and 28, and 27 and 29, of the central electrodes 21 and 22 interfere with each other and are shorted out, which causes characteristic failure. Further, the area of a conductor provided on the side surface of the ferrite member 20 increases, the free coming and going of high-frequency magnetic flux is interfered with, and insertion loss disadvantageously increases.

In the first preferred embodiment, in order to obtain a desired inductance and to set the width of each of the central electrodes 21 and 22 to about 20% to about 45% of the diameter of the ferrite member 20, each of the central electrodes 21 and 22 preferably includes two lines, and the length of each electrode in the width direction of the two lines is preferably about 20% to about 45% of the diameter of the ferrite member 20. The number of lines is preferably 2 to 4.

Each of the central electrodes 21 and 22 preferably includes a copper plate (copper foil) having a thickness of, for example, about 0.01 mm to about 0.1 mm. Such a copper plate is cheap, easy to be processed, and has a low resistivity, and thus a low insertion loss can be realized. Alternatively, a copper alloy, such as brass, phosphor bronze, or beryllium copper, may be coated with a good conductor, such as silver or copper, by plating or evaporation. In this case, by forming an under coat between the coat and the base material, the adhesive force of the coat is stabilized, and rust can be prevented. Specifically, a base plating of copper or nickel of, for example, about 0.1 $\mu$m to about 5 $\mu$m is plated with silver of, for example, about 0.5 $\mu$m to about 10 $\mu$m.

The central electrodes 21 and 22 are fixed to the ferrite member 20 preferably by using an adhesive or sticky insulating film. As a material for the film, polyimide, aramid, polyester, nylon, Teflon®, or Gore-Tex®, or other suitable material, may be used. The thickness of the film is usually, for example, about 0.010 mm to about 0.15 mm. A silicon, acrylic, epoxy, or synthetic rubber material, or other suitable material, is preferably used for the adhesive. Also, as a bonding method, a pressure sensitive method (adhered by pressing), thermosetting, UV setting, or setting by contact with moisture in the air, or other suitable method, can be used.

Figure 2:
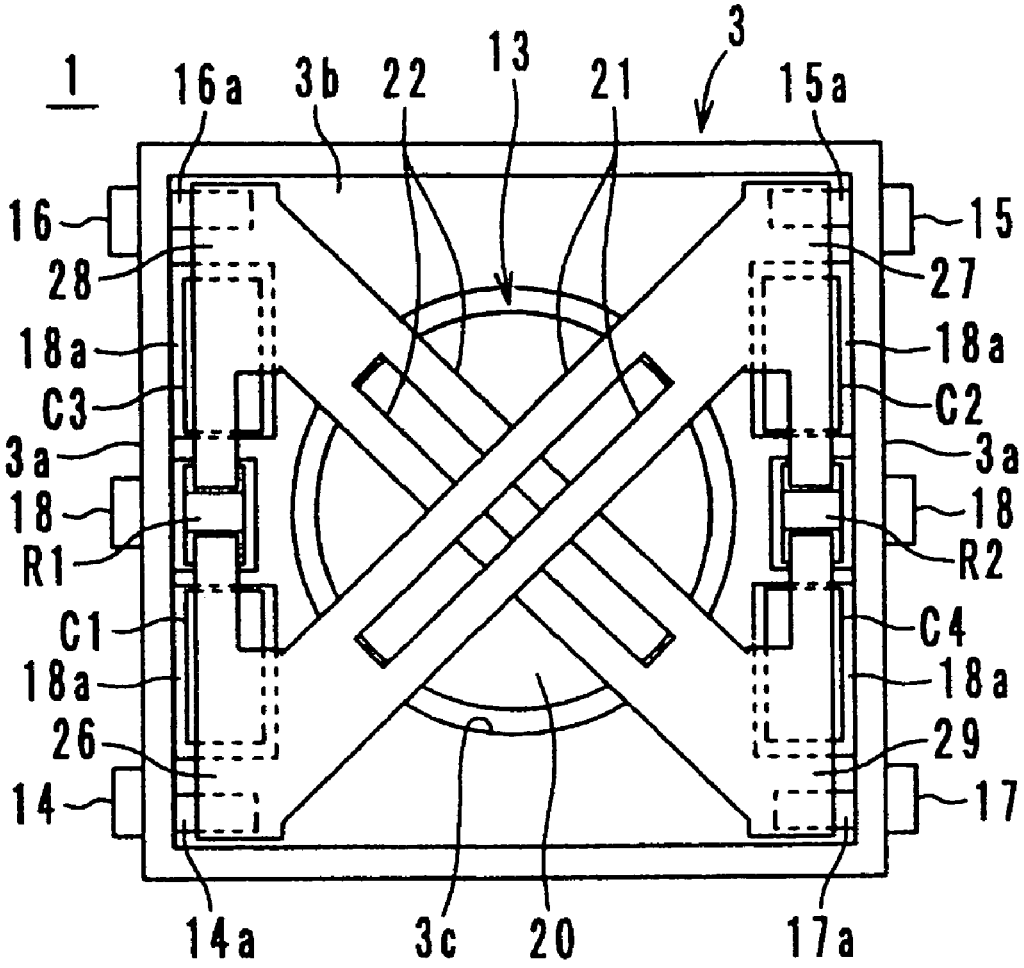
FIG. 2 is a plan view showing the inside of the two-port non-reciprocal circuit device shown in FIG. 1.

As shown in FIG. 2, balanced input terminals 14 and 15, balanced output terminals 16 and 17, and two ground terminals 18 are insertion-molded into the resin terminal case 3. One end of each of the terminals 14 to 18 is led outward through side walls 3*a*, which face each other, of the resin terminal case 3. The other ends thereof are exposed in a bottom portion 3*b* of the resin terminal case 3, and define balanced input lead electrode portions 14*a* and 15*a*, balanced output lead electrode portions 16*a* and 17*a*, and ground lead electrode portions 18*a*, respectively. The balanced input lead electrode portions 14*a* and 15*a* and the balanced output lead electrode portions 16*a* and 17*a* are soldered to the connecting portions 26, 27, 28, and 29 of the central electrodes 21 and 22, respectively. The resin terminal case 3 is preferably made of a heat-resistant resin, such as LCP, PPS, PBT, PEEK, or epoxy resin, or other suitable material.

Each of the matching capacitors C1 to C4 is preferably a single-plate capacitor, in which a hot-side capacitor electrode and a cold-side capacitor electrode are provided on the front and back surfaces of a dielectric substrate, respectively. The hot-side capacitor electrodes of the matching capacitors C1 to C4 are soldered to the connecting portions 26 to 29 of the central electrodes 21 and 22, respectively, and the cold-side capacitor electrodes are soldered to the ground lead electrode portions 18*a*, which are exposed in the resin terminal case 3.

Figure 3:
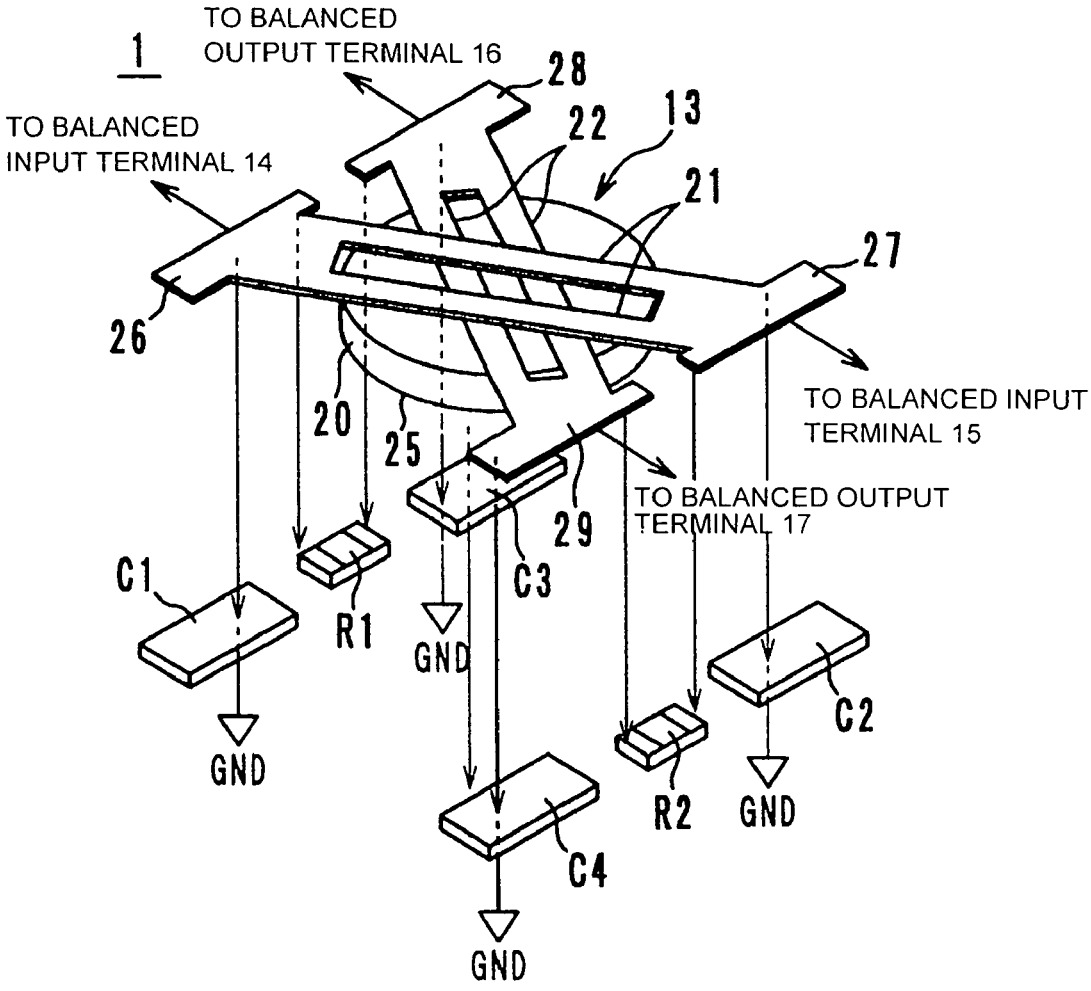
FIG. 3 is a schematic view showing the internal connection state of the two-port non-reciprocal circuit device shown in FIG. 1.

One of terminal electrodes of the resistor R1 is connected to the connecting portion 26 of the central electrode 21, and the other terminal electrode is connected to the connecting portion 28 of the central electrode 22. Likewise, one of terminal electrodes of the resistor R2 is connected to the connecting portion 27 of the central electrode 21, and the other terminal electrode is connected to the connecting portion 29 of the central electrode 22. FIG. 3 shows electrical connection inside the isolator 1. The permanent magnet 9, which is preferably substantially rectangular-shaped in a plan view, usually includes a ferrite magnet preferably made of strontium, barium, or lanthanum, or other suitable material.

The above-described components are assembled in the following manner. First, as shown in FIG. 1, the metallic lower case 4 is attached to the bottom of the resin terminal case 3. Then, the central electrode assembly 13, the matching capacitors C1 to C4, and the resistors R1 and R2 are accommodated in the resin terminal case 3, and the metallic upper case 8 is attached thereto. The permanent magnet 9 and the insulating member 7 are placed between the metallic upper case 8 and the central electrode assembly 13. The permanent magnet 9 applies a DC magnetic field H to the central electrode assembly 13. The lower case 4 and the upper case 8 are bonded by soldering, welding, adhesion, mechanical fit, or any combination of these methods or other suitable methods, so that a metallic case is obtained. The metallic case defines a magnetic circuit, and also functions as a yoke.

Figure 4:
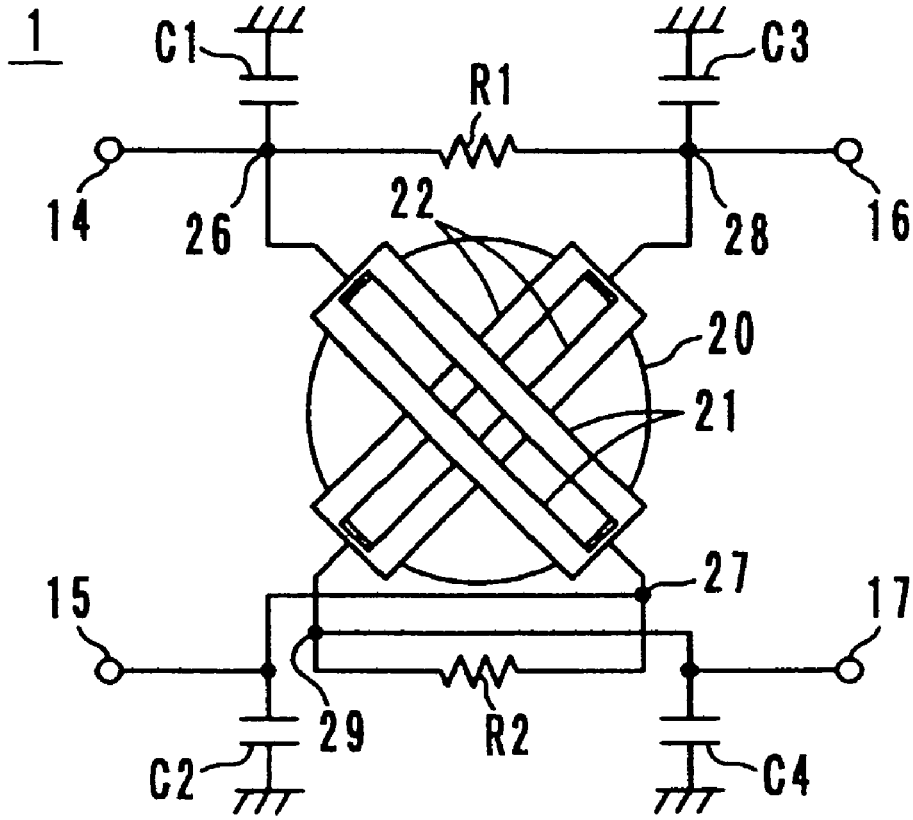
FIG. 4 is an electric equivalent circuit diagram of the two-port non-reciprocal circuit device shown in FIG. 1.

FIG. 4 is an electric equivalent circuit diagram of the isolator 1. The connecting portions 26 and 27 of the first central electrode 21 are electrically connected to the balanced input terminals 14 and 15, respectively. Likewise, the connecting portions 28 and 29 of the second central electrode 22 are electrically connected to the balanced output terminals 16 and 17, respectively. The resistors R1 and R2 are electrically connected between the balanced input terminal 14 and the balanced output terminal 16 and between the balanced input terminal 15 and the balanced output terminal 17, respectively. The matching capacitors C1 to C4 are electrically connected between the connecting portions 26 to 29 of the first and second central electrodes 21 and 22 and ground, respectively.

When a balanced signal (differential signal) is input between the balanced input terminals 14 and 15, a current flows through the first central electrode 21, so that a high-frequency magnetic field is generated in the ferrite member 20. Due to the high-frequency magnetic field, a current flows through the second central electrode 22, which is magnetically coupled with the first central electrode 21. At this time, the crossing angle and the shape of the central electrodes 21 and 22, a DC biased magnetic field of the permanent magnet 9, and the capacitances of the matching capacitors C1 to C4 are adjusted so that the current flowing through the first central electrode 21 is in phase with the current flowing through the second central electrode 22, in other words, so that a potential difference is not generated between the connecting portions 26 and 28 and between the connecting portions 27 and 29. Both ends of the resistors R1 and R2 are at the same potential, and thus a current does not flow through the resistors R1 and R2. Accordingly, the balanced signal is transmitted from the balanced input terminals 14 and 15 to the balanced output terminals 16 and 17. Since a current does not flow through the resistors R1 and R2, the amount of power loss is very small.

On the other hand, when a balanced signal (differential signal) is input between the balanced output terminals 16 and 17, a current flows through the second central electrode 22, and a high-frequency magnetic field is generated in the ferrite member 20. Due to the high-frequency magnetic field, a current flows through the first central electrode 21, which is magnetically coupled with the second central electrode 22. At this time, the crossing angle and the shape of the central electrodes 21 and 22, a DC biased magnetic field of the permanent magnet 9, and the capacitances of the matching capacitors C1 to C4 are adjusted so that most of electric power of the input balanced signal is consumed by the resistors R1 and R2 when a voltage generated at the connecting portions 26 and 27 of the first central electrode 21 is zero. Accordingly, most of the electric power of the balanced signal is consumed by the resistors R1 and R2, so that the balanced signal is hardly transmitted from the balanced output terminals 16 and 17 to the balanced input terminals 14 and 15.

At this time, by setting the resistances of the two resistors R1 and R2 to almost the same value, preferable balance of the isolator 1 can be obtained. That is, the common mode rejection ratio of the isolator 1 increases. When the common mode rejection ratio increases, the amount of balanced signals which have been input to the balanced output terminals 16 and 17 in a common mode and which are transmitted to the balanced input terminals 14 and 15 reduces. As a result, undesired waves other than necessary balanced signal waves are prevented from being passed through the isolator 1, and thus are not transmitted.

Likewise, by setting the capacitances of the two matching capacitors C1 and C2 connected to the both ends of the central electrode 21 to almost the same value, and by setting the capacitances of the two matching capacitors C3 and C4 connected to the both ends of the central electrode 22 to almost the same value, a preferable balance of the isolator 1 can be obtained, and the common mode rejection ratio increases.

The isolator 1 can be connected to a balanced circuit without via a balun. With this configuration, the circuit can be miniaturized and the cost can be reduced. Also, since a balun is not necessary insertion loss and undesired radiation can be reduced. Further, a usable frequency band becomes wider.

The operating center frequency and the operating frequency bandwidth of the isolator 1 depend on the shape and crossing angle of the central electrodes 21 and 22, the size, shape, and characteristics (saturation magnetization $4\pi TMs$, a magnetic loss coefficient $\Delta H$, permittivity, dielectric loss, etc.) of the ferrite member 20, capacitances of the matching capacitors C1 to C4, and the DC biased magnetic field of the permanent magnet 9. At this time, even if the size of the isolator 1 or the shape and size of the ferrite member 20 are restricted, a desired center frequency and input impedance can be obtained while realizing optimal electrical characteristics including insertion loss and an operating frequency bandwidth, by adjusting the capacitances of the matching capacitors C1 to C4.

Further, the cold-side capacitor electrodes of all the matching capacitors C1 to C4 are connected to the ground lead electrode portions 18*a*. Therefore, the matching capacitors C1 to C4 may have a stable horizontal configuration and can be easily assembled. Further, stray capacitance generated between the matching capacitors C1 to C4 and the ground can be minimized, and thus the isolator 1 having very little variation in the electrical characteristics can be obtained.

In addition, electrodes which are not at the ground potential, such as the hot-side capacitor electrodes of the matching capacitors C1 to C4, the terminal electrodes of the resistors R1 and R2, and the input/output lead electrode portions 14*a* to 17*a*, are almost covered by the connecting portions 26 to 29 of the central electrodes 21 and 22. With this configuration, radiation of undesired electromagnetic waves can be minimized. A two-port isolator is often required to have isolation of about 20 dB to about 30 dB or more over a wide band. Therefore, the configuration of this preferred embodiment, in which undesired radiation can be minimized, can be advantageously used.

Second Preferred Embodiment

Figure 5:
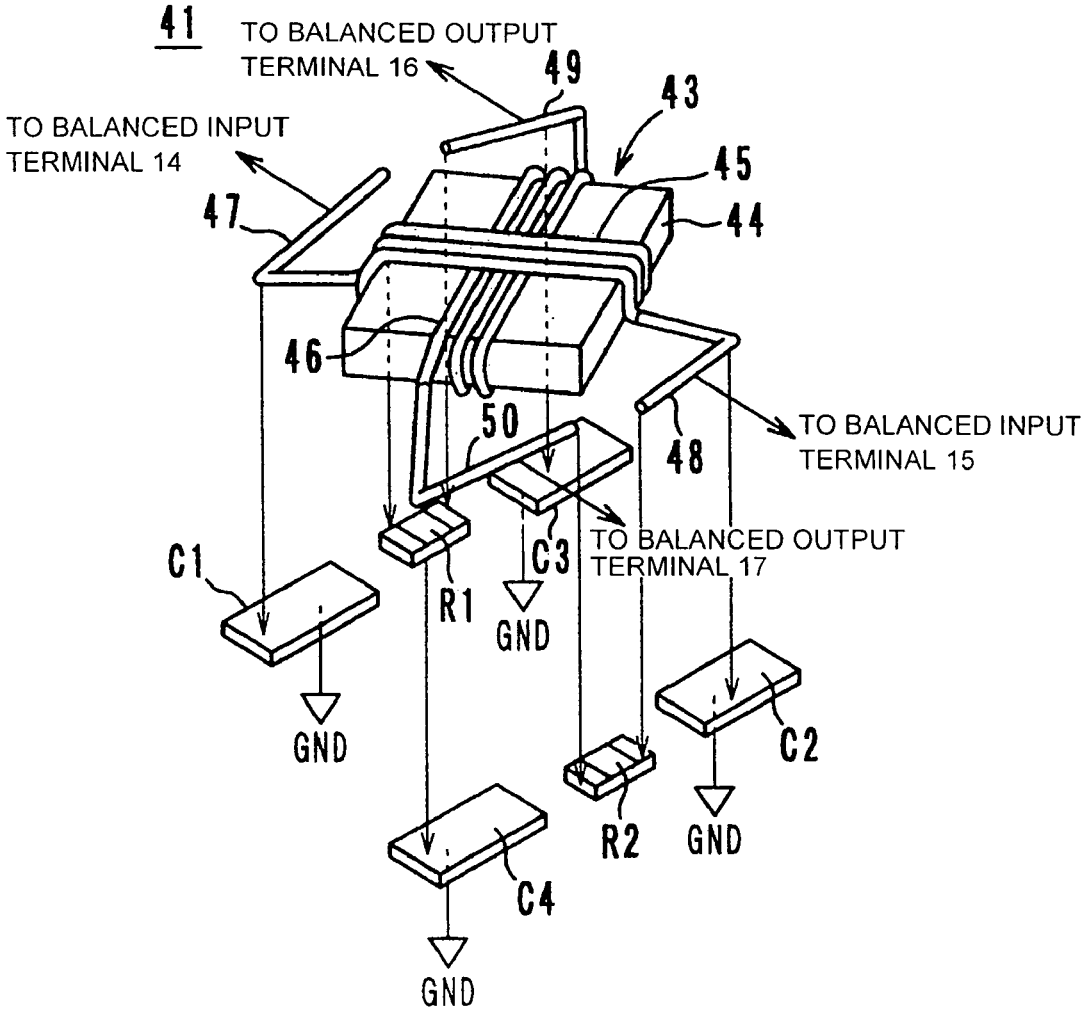
FIG. 5 is a schematic view showing the configuration of a two-port non-reciprocal circuit device according to a second preferred embodiment of the present invention.

A two-port isolator 41 of a second preferred embodiment preferably includes a central electrode assembly 43 shown in FIG. 5.

The central electrode assembly 43 preferably includes a microwave ferrite member 44, which is preferably substantially parallelogram-shaped in a plan view, and central electrodes 45 and 46, which are conductive wires covered with an insulating material. The conductive wires are wound on the surface of the ferrite member 44 such that they cross each other at substantially right angles. More preferably, the shape of the ferrite member 44 is preferably substantially quadrangular (approximately square or approximately rectangle) or substantially rhombic. Alternatively, a substantially circular shape may be adopted.

As the conductive wires, copper wires or silver wires may be used. Alternatively, steel wires may be coated with gold, silver, or copper. The cross section of the conductive wire may be substantially circular or substantially rectangular or other suitable shape. The conductive wire is covered with an insulating material, such as polyester, polyimide, polyimide-amide, polyurethane, or enamel. The conductive wire need not be necessarily covered with an insulating material. In that case, an insulating film is provided between the two central electrodes 45 and 46. Preferably, a space or an insulating material is provided between adjacent portions of the central electrode 45 (or 46) so that the adjacent portions are not shorted out.

Since the central electrodes 45 and 46 are wound on the surface of the ferrite member 44, a space of, for example, about 0.1 mm or more is preferably provided between the central electrode assembly 43 and the metallic case or the like. Alternatively, a dielectric member, a ferrite member, or a ferrite magnet having a thickness of, for example, about 0.1 mm or more may be provided between the central electrode assembly 43 and the metallic case.

An insulating cover is removed at both ends 47, 48, 49, and 50 of the first and second central electrodes 45 and 46. The ends 47 to 50 are soldered to the hot-side capacitor electrodes of the matching capacitors C1 to C4, respectively. One of terminal electrodes of the resistor R1 is soldered to the end 47, and the other terminal electrode thereof is soldered to the end 49. Also, one of terminal electrodes of the resistor R2 is soldered to the end 50, and the other terminal electrode thereof is soldered to the end 48.

The two-port isolator 41 having the above-described configuration has the same operation and advantages as those of the two-port isolator 1 of the first preferred embodiment. Further, in the two-port isolator 41 of the second preferred embodiment, since the central electrodes 45 and 46 are wound on the ferrite member 44, the necessary inductance can be obtained even if the ferrite member 44 is small. As a result, the isolator 41, which has a wide operating frequency band, can be miniaturized while preventing deterioration in the electric characteristics.

Also, when an isolator for the same operating frequency band is designed by using the ferrite member 44 having equal saturation magnetization and equal thickness, the area of the principal surface of the ferrite member 44 can be reduced in the isolator 41 of the second preferred embodiment, compared to the isolator 1 of the first preferred embodiment. Therefore, the demagnetizing factor N of the ferrite member 44 is reduced, so that a necessary DC magnetic field applied by the permanent magnet can be reduced. As a result, the thickness of the permanent magnet can be reduced, and thus the thickness of the isolator 41 can be reduced.

By using the ferrite member 44 preferably having a substantially parallelogram-shaped principal surface and by setting an angle defined by adjacent side surfaces of the ferrite member 44 to a desired angle, the crossing angle of the central electrodes 45 and 46 can be easily stabilized. As a result, insertion loss and isolation of the isolator 41 can be improved. Further, by setting the distance between side surfaces facing each other of the ferrite member 44 to a predetermined value, the length, that is, the inductance, of the central electrodes 45 and 46 can be easily set without variation.

Third and Fourth Preferred Embodiments

Figure 6:
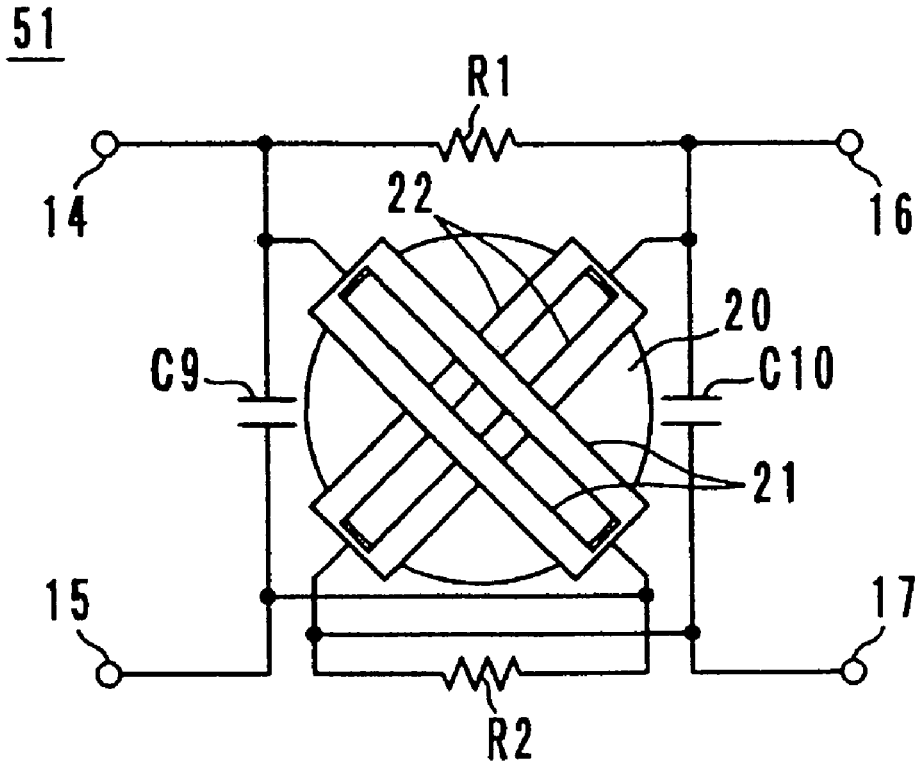
FIG. 6 is an electric equivalent circuit diagram of a two-port non-reciprocal circuit device according to a third preferred embodiment of the present invention.

FIG. 6 is an electric equivalent circuit diagram of an isolator 51 of a third preferred embodiment. Both ends of a first central electrode 21 are electrically connected to balanced input terminals 14 and 15, respectively. Also, both ends of a second central electrode 22 are connected to balanced output terminals 16 and 17, respectively. Resistors R1 and R2 are electrically connected between the balanced input terminal 14 and the balanced output terminal 16 and between the balanced input terminal 15 and the balanced output terminal 17, respectively. A matching capacitor C9 is electrically connected between both ends of the first central electrode 21 and a matching capacitor C10 is electrically connected between both ends of the second central electrode 22. With this configuration, the number of matching capacitors and connecting portions can be reduced, and thus the inexpensive, compact, and highly reliable isolator 51 can be obtained.

Figure 7:
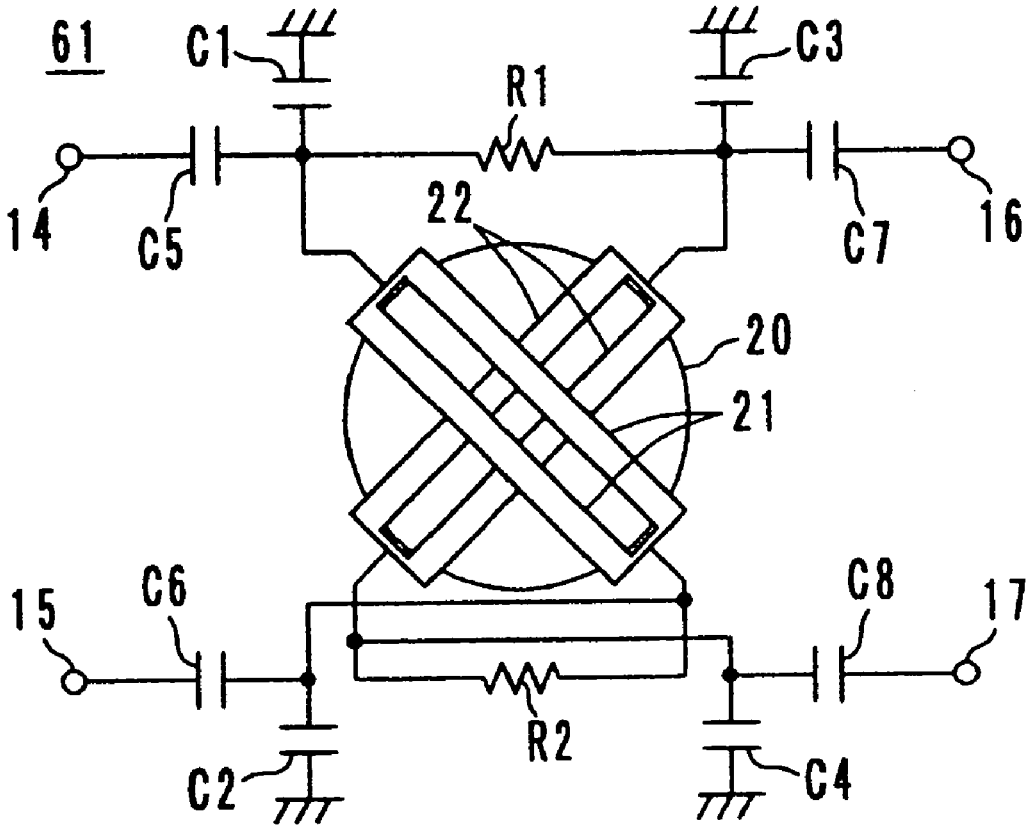
FIG. 7 is an electric equivalent circuit diagram of a two-port non-reciprocal circuit device according to a fourth preferred embodiment of the present invention.

FIG. 7 is an electric equivalent circuit diagram of an isolator 61 of a fourth preferred embodiment. The isolator 61 is preferably the same as the isolator 1 of the first preferred embodiment except that the balanced input terminals 14 and 15 and the balanced output terminals 16 and 17 are electrically connected to the central electrodes 21 and 22 through matching capacitors C5, C6, C7, and C8, respectively. The matching capacitors C5 to C8 also function as DC voltage blocking capacitors. Therefore, this configuration is effective when a first-stage circuit is electrically connected to a subsequent-stage circuit by a signal line with the isolator 61 therebetween, and when a DC voltage is superimposed on the first-stage circuit and the DC voltage should not be transmitted to the subsequent-stage circuit.

Fifth Preferred Embodiment

Figure 8:
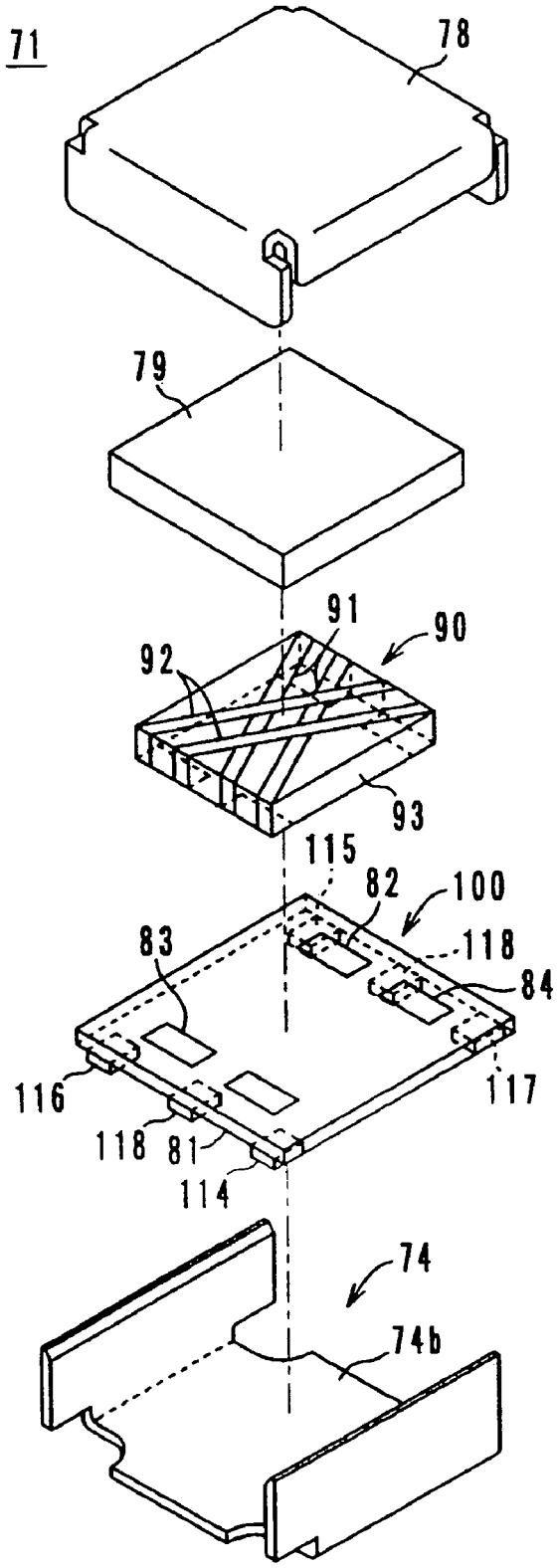
FIG. 8 is an exploded perspective view showing a two-port non-reciprocal circuit device according to a fifth preferred embodiment of the present invention.

As shown in FIG. 8, a two-port isolator 71 preferably includes a metallic case having a metallic lower case 74 and a metallic upper case 78, a permanent magnet 79, a central electrode assembly 90 and a substantially rectangular laminated substrate 100 having terminator resistors R1 and R2 and matching capacitors C1 to C4.

In the central electrode assembly 90, two pairs of central electrodes 91 and 92 are arranged on the upper surface of a microwave ferrite member 93, which is preferably substantially rectangular-shaped when viewed in a plan view, such that the central electrodes 91 and 92 cross each other at substantially right angles and an insulating layer (not shown) is provided therebetween. In the fifth preferred embodiment, each of the central electrodes 91 and 92 includes two lines.

The central electrodes 91 and 92 may be bonded to the ferrite member 93 by using a copper foil, or may be provided by printing a conductive paste including Ag, Au, Ag—Pd, or Cu on the ferrite member 93. The conductive paste preferably includes a photosensitive resin. After the conductive paste is printed on the entire surface of the ferrite member 93, exposure and development are performed so as to remove an unnecessary portion, and then the conductive paste is fired. Accordingly, the central electrodes 91 and 92 formed of a thick film can be obtained with highly-accurate positioning, and thus a stable electrical characteristic can be obtained.

The laminated substrate 100 includes a dielectric sheet provided with connecting electrodes 81 to 84 for the central electrodes, a dielectric sheet whose surface is provided with capacitor electrodes and resistors R1 and R2, balanced input terminals 114 and 115, balanced output terminals 116 and 117, and ground terminals 118.

The laminated substrate 100 is preferably fabricated in the following way. The dielectric sheet is fabricated by using a low-temperature-sintered dielectric material whose main ingredient is preferably $Al_2O_3$ and whose sub-ingredient is preferably one or more of $SiO_2$, SrO, CaO, PbO, $Na_2O$, $K_2O$, MgO, BaO, $CeO_2$, and $B_2O_3$.

Further, a shrinkage-suppressing sheet which is not fired under the firing condition (in particular, firing temperature of about 1000° C. or less) of the laminated substrate 100 and which suppresses shrinkage by firing of the laminated substrate 100 in the plane direction (X-Y direction) is fabricated. The shrinkage suppressing sheet preferably includes a mixture of alumina powder and stabilized zirconia powder.

The connecting electrodes 81 to 84 for the central electrodes and the capacitor electrodes are formed in the dielectric sheet preferably by using screen printing or photolithography. As a material for the electrodes 81 to 84, Ag, Cu, or Ag—Pd, which has a low resistivity and which can be fired with the dielectric sheet, can preferably be used.

The resistors R1 and R2 are formed on the surface of the dielectric sheet by screen printing or other suitable process. The resistors R1 and R2 preferably are made of cermet, carbon, or ruthenium, or other suitable material.

Also, via-holes for signals are preferably formed in the following way. First, holes for via-holes are formed in advance in the dielectric sheet by laser process or punching process, and then a conductive paste is filled in the holes. Generally, the same material (Ag, Cu, or Ag—Pd) as that for the electrodes 81 to 84 is preferably used for the conductive paste.

The capacitor electrodes face each other with the dielectric sheet therebetween so as to constitute the matching capacitors C1 to C4. The matching capacitors C1 to C4, the resistors R1 and R2, the electrodes 81 to 84, and the via-holes constitute an electric circuit similar to that shown in FIG. 4 in the laminated substrate 100.

The dielectric sheets are laminated and are sandwiched by the shrinkage-suppressing sheets, and are then fired. Accordingly, a sintered member is obtained. Then, unsintered shrinkage-suppressing material is removed by ultrasonic cleaning or wet honing, so as to obtain the laminated substrate 100.

The balanced input terminals 114 and 115, the balanced output terminals 116 and 117, and the ground terminals 118 protrude from the bottom surface of the laminated substrate 100. The surface of the thick-film terminals 114 to 118 is preferably plated with Ni having a thickness of about 1 $\mu$m to about 10 $\mu$m, and furthermore, the surface thereof is preferably plated with gold having a thickness of about 0.5 $\mu$m or less. This method is adopted for improving solderability (wettability) of the terminals 114 to 118 and for preventing melting into solder (erosion by solder) and migration of the terminals 114 to 118.

The above-described components are preferably assembled in the following way. The permanent magnet 79 is fixed to the ceiling of the metallic upper case 78 by using an adhesive. The central electrode assembly 90 is mounted on the laminated substrate 100 by soldering the ends of the central electrodes 91 and 92 to the connecting electrodes 81 to 84, which are provided on the upper surface of the laminated substrate 100.

The laminated substrate 100 is provided on a bottom portion 74*b* of the metallic lower case 74. Further, the ground electrodes provided on the back surface of the laminated substrate 100 are fixed to the bottom portion 74*b* by soldering, and are electrically connected thereto.

In the isolator 71, screen printing and photolithography are preferably used for forming the central electrodes 91 and 92 and the laminated substrate 100, and thus the complicated circuit and wiring can be formed with very high precision. Accordingly, a band-pass filter (BPF), a low-pass filter (LPF), a band-elimination filter (BEF or notch filter), a directional coupler, and a coupler by capacitance can be easily provided in the isolator 71.

Sixth to Eighth Preferred Embodiments

Figure 9:
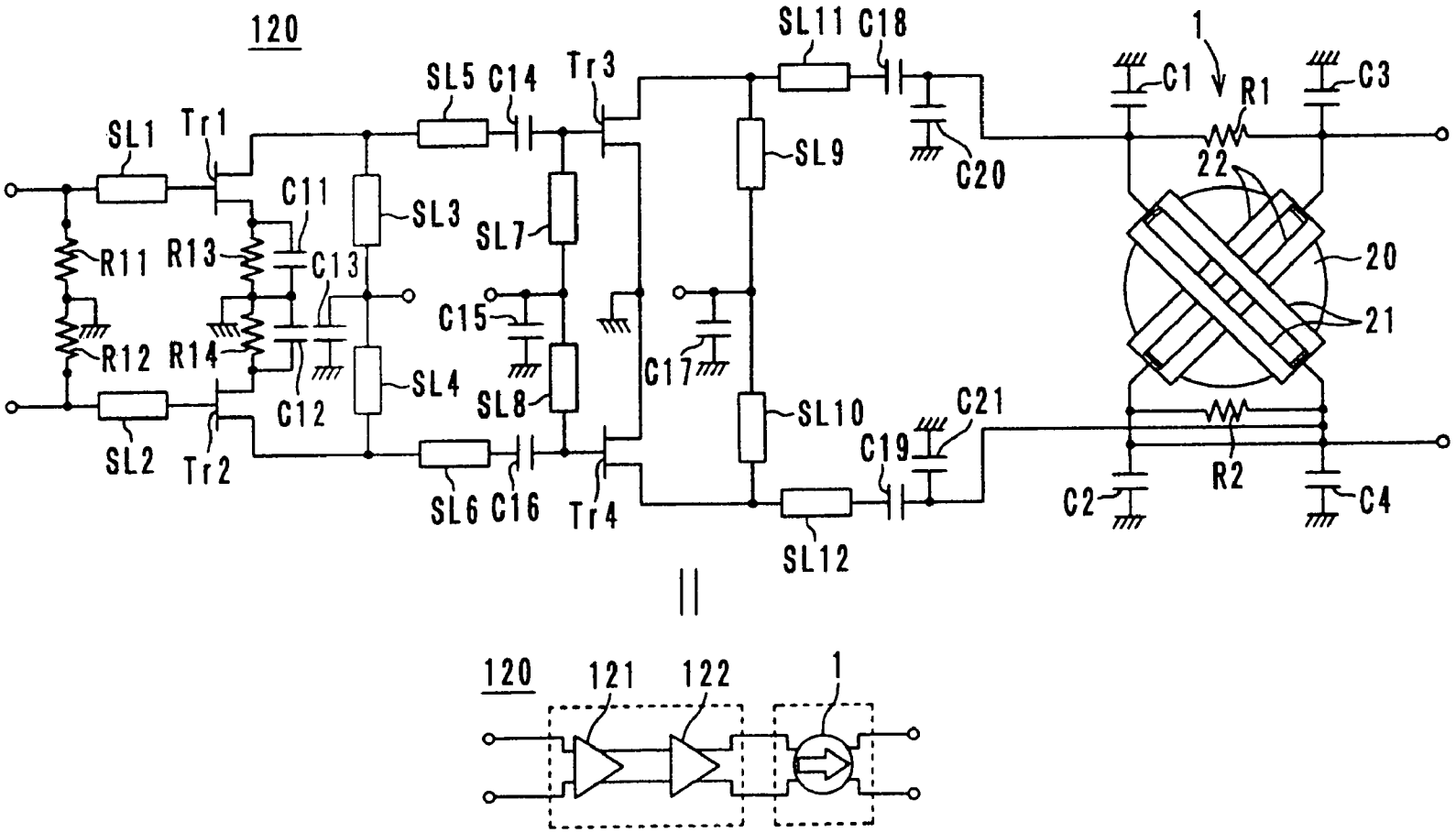
FIG. 9 is an electric circuit diagram showing a composite electronic component according to preferred embodiments of the present invention.

FIG. 9 is an electric circuit diagram of a composite electronic component 120, in which the isolator 1 of the first preferred embodiment is connected to balanced amplifiers 121 and 122. In FIG. 9, the composite electronic component 120 includes resistors R11 to R14, inductors SL1 to SL12, first-stage field-effect transistors Tr1 and Tr2, last-stage field-effect transistors Tr3 and Tr4, and capacitors C11 to C21.

In the composite electronic component 120, a load impedance from the side of the output terminal of the balanced amplifier 122 is constant regardless of the operating state of the latter-stage circuit (for example, whether power is supplied to the latter-stage circuit or not, or the state of power supply voltage) or the operation environment (for example, ambient temperature or operating state of a load device, such as an antenna device). As a result, the power load efficiency and the output distortion characteristic of the balanced amplifiers 121 and 122 can be constantly kept at an optimal state.

Figure 10:
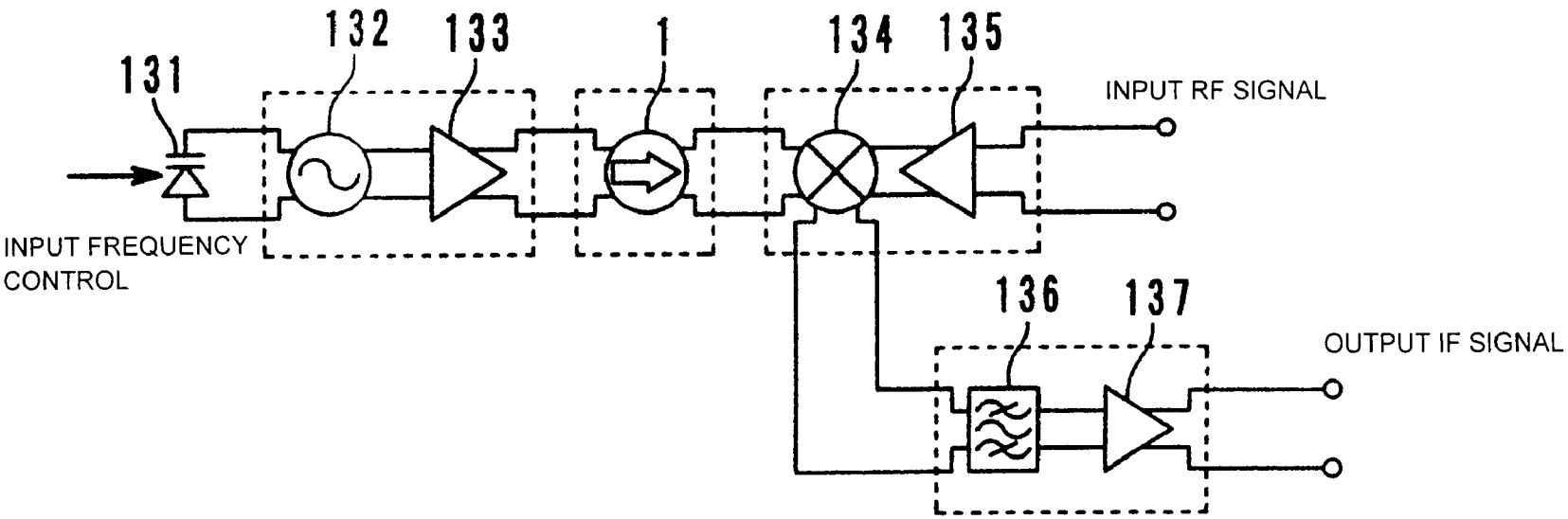
FIG. 10 is an electric circuit block diagram showing an example of a circuit including the two-port non-reciprocal circuit device shown in FIG. 1.

FIG. 10 is a block diagram of an electric circuit in which the isolator 1 of the first preferred embodiment is provided between a balanced oscillator 132 and a balanced frequency mixer 134. In FIG. 10, the circuit includes a variable-capacitance diode 131, balanced amplifiers 133, 135, and 137, and a balanced filter (for example, surface acoustic wave filter) 136.

In this circuit, a load impedance from the side of the output terminal of the balanced amplifier 133 is constant regardless of the operating state of the balanced frequency mixer 134 and the balanced filter 136 or the operation environment of this circuit. As a result, the oscillation frequency and output power of the balanced oscillator 132 do not vary, and thus the optimal operating state can be constantly maintained. In particular, even when the power of the balanced frequency mixer 134 is supplied intermittently, the oscillation frequency of the balanced oscillator 132 does not vary instantaneously.

Figure 11:
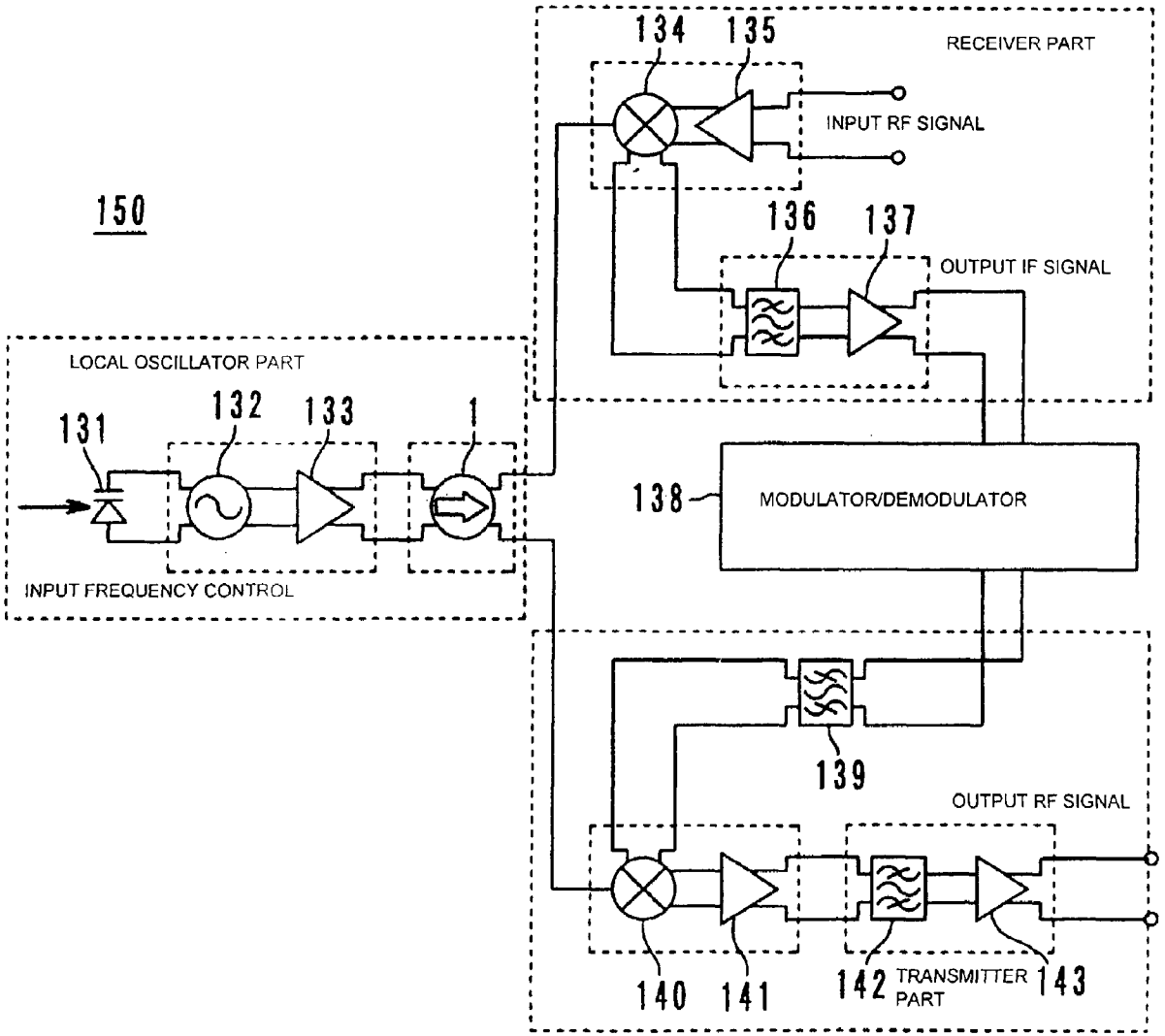
FIG. 11 is an electric circuit block diagram showing a communication apparatus according to another preferred embodiment of the present invention.

FIG. 11 is a block diagram of an electric circuit in which the isolator 1 of the first preferred embodiment is incorporated into an RF portion of a mobile phone 150, which is a communication apparatus. In FIG. 11, the circuit preferably includes a balanced modulator/demodulator 138, balanced filters 139 and 142, a balanced frequency mixer 140, and balanced amplifiers 141 and 143. One of the balanced output terminals of the isolator 1 is connected to the frequency mixer 134 in a receiver portion, and the other balanced output terminal is connected to the frequency mixer 140 in a transmitter portion.

In this circuit, the oscillation frequency and the output power of the balanced oscillator 132 does not vary, and the optimal operating state can be constantly maintained. In particular, even when the power of the frequency mixer 140 in the transmitter portion is supplied intermittently, the output of the oscillator 132, which is supplied to the receiver portion, does not vary instantaneously. Further, the isolator 1 has a function of distributing the output of the oscillator 132.

Other Preferred Embodiments

The present invention is not limited to the above-described preferred embodiments, and various modifications can be adopted within the scope of the present invention. For example, the two-port non-reciprocal circuit device according to the present invention may be a non-reciprocal circuit device including a coupler, other than the isolator.

As described above, according to various preferred embodiments of the present invention, the two-port non-reciprocal circuit device includes balanced input/output terminals, and thus the two-port non-reciprocal circuit device can be connected to a balanced circuit without via a balun. Also, the resistance of the first resistor, which is electrically connected between one end of the first central electrode and one end of the second central electrode, is almost equal to the resistance of the second resistor, which is electrically connected between the other end of the first central electrode and the other end of the second central electrode. Accordingly, the common mode rejection ratio of the two-port non-reciprocal circuit device is increased. As a result, undesired waves other than necessary balanced signal waves are prevented from passing through the two-port non-reciprocal circuit device, and are not transmitted.

Also, by setting the capacitances of the two matching capacitors which are electrically connected between both ends of at least one of the first and second central electrodes and ground to almost the same values, the common mode rejection ratio of the two-port non-reciprocal circuit device can be increased.

The present invention is not limited to each of the above-described preferred embodiments, and various modifications are possible within the range described in the claims. An embodiment obtained by appropriately combining technical features disclosed in each of the different preferred embodiments is included in the technical scope of the present invention.

What is claimed is:

1. A two-port non-reciprocal circuit device comprising:

a permanent magnet;

a ferrite member to which a DC magnetic field is applied by the permanent magnet;

a first central electrode provided on the ferrite member;

a second central electrode provided on the ferrite member, the first and second central electrodes crossing each other and being electrically insulated from each other;

a first resistor which is electrically connected between a first end of the first central electrode and a first end of the second central electrode;

a second resistor which is electrically connected between a second end of the first central electrode and a second end of the second central electrode;

a first terminal which is electrically connected to the first end of the first central electrode and a second terminal which is electrically connected to the second end of the first central electrode; and a third terminal which is electrically connected to the first end of the second central electrode and a fourth terminal which is electrically connected to the second end of the second central electrode; wherein the first and second terminals are balanced input terminals and the third and fourth terminals are balanced output terminals.

2. A two-port non-reciprocal circuit device according to claim 1, wherein a matching capacitor is electrically connected between the first and second ends of the first central electrode and a matching capacitor is electrically connected between both ends of the second central electrode.

3. A two-port non-reciprocal circuit device according to claim 1, wherein matching capacitors are electrically connected between at least one of the first and second ends of each of the first and second central electrodes and ground.

4. A two-port non-reciprocal circuit device according to claim 1, wherein two matching capacitors are electrically connected between the first and second ends of at least one of the first and second central electrodes and ground, and capacitances of the two matching capacitors, which are electrically connected to the first and second ends of one of the central electrodes, are almost equal to each other.

5. A two-port non-reciprocal circuit device according to claim 1, wherein at least one of the first to fourth terminals is electrically connected to the first or second central electrode via a matching capacitor.

6. A two-port non-reciprocal circuit device according to claim 1, wherein resistances of the first and second resistors are almost equal to each other.

7. A two-port non-reciprocal circuit device according to claim 1, wherein the ferrite member is substantially parallelogram-shaped when viewed in a plan view.

8. A composite electronic component comprising:

the two-port non-reciprocal circuit device according to claim 1; and a power amplifier which is electrically connected to the two-port non-reciprocal circuit device; wherein a balanced output terminal of the power amplifier is electrically connected to one of the balanced input terminals of the two-port non-reciprocal circuit device.

9. A communication apparatus comprising the two-port non-reciprocal circuit device according to claim 1.

10. A communication apparatus comprising the composite electronic component according to claim 8.

11. A two-port non-reciprocal circuit device according to claim 1, further comprising a case including a metallic lower case and a metallic upper case, an outer surface of the case being plated with one of Ag and Cu, and the case being arranged to contain the permanent magnet, the ferrite member, the first and second central electrodes, the first and second resistors, and the first to fourth terminals.

12. A two-port non-reciprocal circuit device according to claim 1, wherein a width of each of the first and second central electrodes is preferably about 20% to about 45% of a diameter of the ferrite member.

13. A two-port non-reciprocal circuit device according to claim 1, wherein each of the first and second central electrodes includes a copper plate having a thickness of about 0.01 mm to about 0.1 mm.

14. A two-port non-reciprocal circuit device according to claim 1, wherein the first and second resistors are electrically connected between at least one of the balanced input terminals and at least one of the balanced output terminals.

15. A two-port non-reciprocal circuit device according to claim 1, wherein the first and second resistors are electrically connected between each of the balanced input terminals and each of the balanced output terminals.

16. A two-port non-reciprocal circuit device according to claim 1, wherein both ends of the first and second resistors are at the same potential.

17. A two-port non-reciprocal circuit device according to claim 1, wherein the two-port non-reciprocal circuit device is a two-port isolator.

18. A two-port non-reciprocal circuit device according to claim 1, wherein the first and second central electrodes are wound on the ferrite member.

19. A two-port non-reciprocal circuit device according to claim 1, wherein the ferrite member has a substantially parallelogram-shaped principal surface.

20. A two-port non-reciprocal circuit device according to claim 1, wherein at least two pairs of the first and second central electrodes are provided on a surface of the ferrite member.

* * * * *